US006183877B1

(12) United States Patent
Bell et al.

(10) Patent No.: US 6,183,877 B1
(45) Date of Patent: Feb. 6, 2001

(54) CAST-ALUMINA METAL MATRIX COMPOSITES

(75) Inventors: James Alexander Evert Bell, Oakville (CA); Pradeep Kumar Rohatgi, Milwaukee, WI (US); Thomas Francis Stephenson, Toronto; Anthony Edward Moline Warner, Burlington, both of (CA)

(73) Assignee: Inco Limited, Toronto (CA)

( * ) Notice: Under 35 U.S.C. 154(b), the term of this patent shall be extended for 0 days.

(21) Appl. No.: 08/915,097

(22) Filed: Aug. 20, 1997

Related U.S. Application Data

(60) Provisional application No. 60/041,188, filed on Mar. 21, 1997.

(51) Int. Cl.[7] ..... C22C 21/02; C22C 21/04; C22C 21/08; B22D 21/04

(52) U.S. Cl. ..... 428/545; 428/293.1; 148/549; 148/439

(58) Field of Search ..... 428/615, 614, 428/545, 546, 549, 548, 105, 113, 552, 553, 650, 652, 654, 293.1; 420/528, 550; 148/437, 415, 549, 439; 117/939, 950, 937

(56) References Cited

U.S. PATENT DOCUMENTS

| | | | | |
|---|---|---|---|---|
| 3,885,959 | | 5/1975 | Badia et al. | 75/138 |
| 4,409,298 | | 10/1983 | Albertson et al. | 428/614 |
| 4,708,104 | | 11/1987 | Day et al. | 123/193 P |
| 4,959,276 | | 9/1990 | Hagiwara et al. | 428/614 |
| 5,449,421 | * | 9/1995 | Hamajima et al. | 148/415 |
| 5,514,480 | * | 5/1996 | Takagi et al. | 428/549 |
| 5,578,386 | * | 11/1996 | Bell et al. | 428/614 |
| 5,626,692 | | 5/1997 | Rohatgi et al. | 148/538 |
| 5,705,280 | * | 1/1998 | Doty | 428/539.5 |
| 5,773,733 | * | 6/1998 | Tuan | 75/235 |

FOREIGN PATENT DOCUMENTS

| | | | |
|---|---|---|---|
| 0367229 | | 6/1990 | (EP) . |
| 0566098 | | 10/1990 | (EP) . |
| 56-116851 | | 9/1981 | (JP) . |
| 58-81948 | | 5/1983 | (JP) . |
| 58-147532 | * | 9/1983 | (JP) . |
| 61-266530 | * | 11/1986 | (JP) . |
| 1230737 | | 9/1989 | (JP) . |
| 6287664 | | 10/1994 | (JP) . |

OTHER PUBLICATIONS

Song et al., "Mechanical Properties and Solid Libricant . . . " in J. Compos. Mater. 31(4) Feb. 1997, pp. 316–344.*

Patent Abstracts of Japan, vol. 006, No. 180 (C–125), Nissan Motor Co., Ltd., Sep. 14, 1982.

Patent Abstracts of Japan, vol. 013, No. 510 (C–654), Furukawa Electric Co., Ltd., Nov. 15, 1989.

Rohatgi et al., "Tribological Properties of Al–Si–Gr–SiC Hybrid Composite," Proceeding of the ASM 1993 Materials Congress, pp. 21 to 25, (Oct.).

* cited by examiner

*Primary Examiner*—Deborah Jones
*Assistant Examiner*—Michael LaVilla
(74) *Attorney, Agent, or Firm*—Blake T. Biederman; Edward A. Steen

(57) ABSTRACT

This composite consists of an aluminum-alloy matrix containing by volume percent, 0.4 to 8.8 alumina, 1 to 4.4 carbon or graphite and 0.5 to 20 nickel-bearing aluminide. The alumina particles have an average size between 3 and 250 μm and the carbon and graphite particles have an average size between 10 and 250 μm. The composite is cast by stirring alumina and carbon or graphite contained in a molten aluminum or aluminum-base alloy to form a molten mixture. The molten mixture is cast directly from a temperature above the liquidus of the matrix alloy. While solidifying, carbon or graphite particles delay or hinder the settling of alumina to create a more uniform composite structure. The resulting composite structure contains an aluminum-base alloy, alumina, carbon or graphite and nickel-bearing aluminide dispersoids.

1 Claim, 3 Drawing Sheets

CAST-ALUMINA METAL MATRIX COMPOSITES

This application claims the benefit of U.S. Provisional application No. 60/041,188, filed Mar. 21, 1997.

FIELD OF INVENTION

This invention relates to aluminum-base metals containing alumina and carbon or graphite particles. In particular, this invention relates to the casting of alumina-containing metal matrix composites (MMCs).

BACKGROUND OF THE INVENTION

Rohatgi et al, in U.S. Pat. No. 5,626,692, disclose that nickel-coated graphite particles and silicon carbide particles can combine to produce a neutral buoyancy mixture. This neutral buoyancy mixture hinders low-density graphite from floating and high-density silicon carbide particles from sinking in molten aluminum-base matrices. The stability of this molten mixture allows casting of metal matrix composites without special rapid-solidification equipment. This neutral buoyancy method provided the first commercially viable method for casting aluminum-base composites with silicon carbide and graphite particles.

These hybrid silicon carbide-graphite composites provide excellent wear resistance at low cost. Although manufacturers readily machine these hybrid composites, the "hard" silicon carbide particles accelerate tool wear rates of tungsten carbide tools Diamond (PCD and CVD-diamond-coated carbides) have sufficient hardness to machine silicon carbide reinforced metal matrix composites. These diamonds tools however are very expensive, do not resist shocks that occur with interrupted cutting and are only available in limited shapes and sizes. The accelerated wear rates of machining silicon carbide-containing composites can increase machining costs of some applications beyond acceptable limits for certain applications.

It is an object of the invention to form a wear resistant composite.

It is a further object of the invention to provide a composite that facilitates casting without excessive segregation.

It is a further object of this invention to provide a composite that machines with decreased tool wear rates.

SUMMARY OF THE INVENTION

This composite consists of an aluminum-alloy matrix containing by volume percent, 0.4 to 8.8 alumina, 1 to 4.4 carbon or graphite and 0.5 to 20 nickel-bearing aluminide. The alumina particles have an average size between 3 and 250 $\mu$m and the carbon and graphite particles have an average size between 10 and 250 $\mu$m. The composite is cast by stirring alumina and carbon or graphite contained in a molten aluminum or aluminum-base alloy to form a molten mixture. The molten mixture is cast directly from a temperature above the liquidus of the matrix alloy. While solidifying, carbon or graphite particles delay or hinder the settling of alumina to create a more uniform composite structure. The resulting composite structure contains an aluminum-base alloy, alumina, carbon or graphite and nickel-bearing aluminide dispersoids.

DESCRIPTION OF PREFERRED EMBODIMENTS

Figure 1:
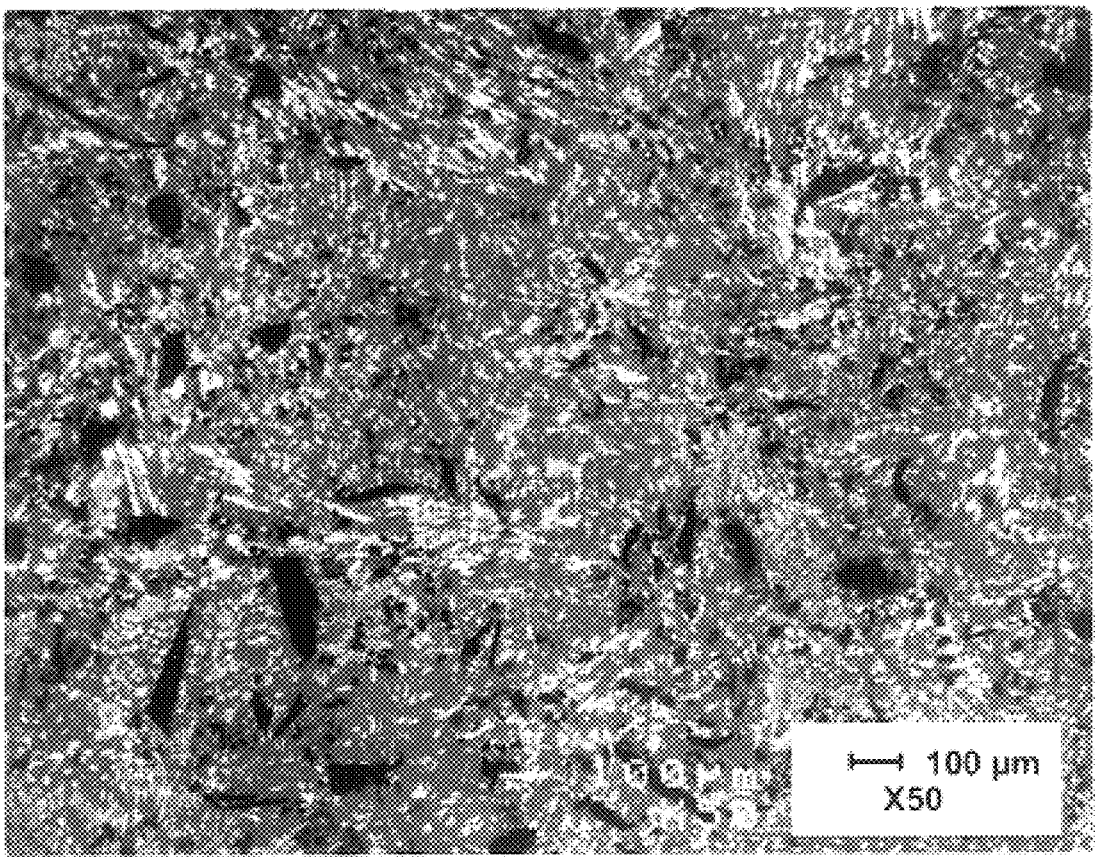
FIG. 1 is a 50X SEM micrograph of the composite of the invention formed with 5 volume percent alumina and 3.5 volume percent graphite.

This composite provides a stable alumina-containing-aluminum-alloy-matrix composite capable of being cast with conventional equipment. This invention uses carbon or graphite to hinder the setting of high-density alumina particles, which in turn dramatically increases the castability of the composite and increases uniformity of the dispersion of the particles in the part.

The MMC ideally contains alumina and carbon or graphite (Gr) in the following proportions to achieve neutral buoyancy. For particles of the same size:

$$V_{A1203}=0.42\ V_{C\ or\ Gr}$$

$$m_{A1203}=0.74\ m_{C\ or\ Gr}$$

$$V=Volume$$

$$m=Mass$$

Note: The above formula assumes an aluminum matrix density of 2.7 g/cc, a carbon density of 2.2 g/cc and an alumina density of 3.9 g/cc.

In accordance with the neutral buoyancy concept, carbon or graphite ideally occupies 1 to 4 volume percent and alumina forms 0.42 to 1.68 volume percent of the composite. However, if a higher fraction of alumina is desired to achieved better wear properties, finer alumina particles, which settle in the melt slower than a larger alumina particles, can be used. Mixing alumina and graphite together in the melt distributes these items uniformly throughout the composite. Achieving neutral buoyancy allows the casting of these composites in slow-cooling molds, such as sand molds without significant settling of the alumina. Limiting volume percent of carbon or graphite to about 4 volume percent reduces the strength loss of the MMC and provides excellent lubricating properties. An addition of at least 1.5 or 2 volume percent graphite provides the best lubrication for wear resistant applications.

Introducing nickel-coated graphite into the matrix is the most effective means for adding graphite into molten aluminum. The nickel facilitates wetting of the graphite and forms nickel aluminide dispersoids during solidification. The nickel-bearing aluminide phases increase wear resistance of the composite. Ideally, the solidified volume fraction of the nickel-bearing aluminide phases is between 1.8 and 12 volume percent. The alloy optionally contains elements to promote aluminide formation such as: 0 to 3 weight percent iron; and 0 to 2 weight percent magnesium—with some aluminum-base-matrix alloys it's possible to incorporate even greater quantities of iron and magnesium. Most advantageously, the matrix alloy contains 0.5 to 2 weight percent iron, 0.1 to 1 weight percent magnesium and 5 to 19 weight percent silicon. Most advantageously, the matrix contains 5 to 15 weight percent silicon.

Optionally, introducing nickel-coated alumina into the melt increases wetability of the alumina and reacts with aluminum to form the nickel aluminides. Finally, it is possible to simply add nickel to the matrix alloy. If the nickel does not coat the graphite, an additional means of wetting the graphite will be necessary to introduce the graphite into the molten aluminum. Alternatively, introducing iron into the melt increases the proportion of nickel-containing intermetallics in the composite.

EXAMPLE 1

Melting, degassing and skimming 23.1 kg of aluminium alloy 413.0 provided the starting point for preparing the alloy. Argon gas protected the molten alloy, while adding 8.26 kg of alumina-bearing composite (22 volume percent alumina) to the melt. After adding this alloy, volume percent alumina measured 5.1 percent. Agitating in 615 g of nickel-coated graphite particles (50 wt % Ni) produced an alloy nominally containing 3.5 volume percent graphite. After stirring this molten mixture for several hours, casting the mixture at 700° C. into an ASTM test bar mould produced test samples.

Actual chemical as say of the sample (Alloy 1) resulted in the following composition:

TABLE 1

| | Bulk Analysis-Weight Percent | | | | | |
|---|---|---|---|---|---|---|
| | Al | Ni | C | $Al_2O_3$ | Si | Fe |
| Alloy 1 | 73.5* | 3.39 | 2.64 | 7.2 | 8.8 | 0.7 |

*Balance plus incidental impurities.

Table 2 below provides the volumetric ratio of alumina to graphite and an analysis of the nickel aluminide of Alloy 1.

| | C (vol %) | $Al_2O_3$ (vol %) | Ni (wt %) | Fe (wt %) | Si (wt %) | Al (wt %) | Mg (wt %) |
|---|---|---|---|---|---|---|---|
| Bulk | 3.3 | 50 | | | | | |
| Intermetallic | | | 23.3 | 8.4 | 2.4 | 63.2 | 1.8 |

Referring to FIG. 1, the SEM micrograph illustrates a typical section of the composite. This alloy contained a greater amount of nickel-bearing intermetallics than previous hybrid composite alloys based on a Duralcan F3S.20S (20 volume percent SiC)+A356 composition. The high iron levels in 413.0 alloy and the magnesium content of composite appear to increase the volume fraction of the aluminide phase.

The average particle size of the graphite was approximately 85 $\mu$m. Alumna, having an average particle size of only 10 $\mu$m, stabilized the graphite without excessive sinking in the melt. FIG. 1 illustrates groupings of alumina particles that surround and stabilize the larger graphite particles.

Figure 2:
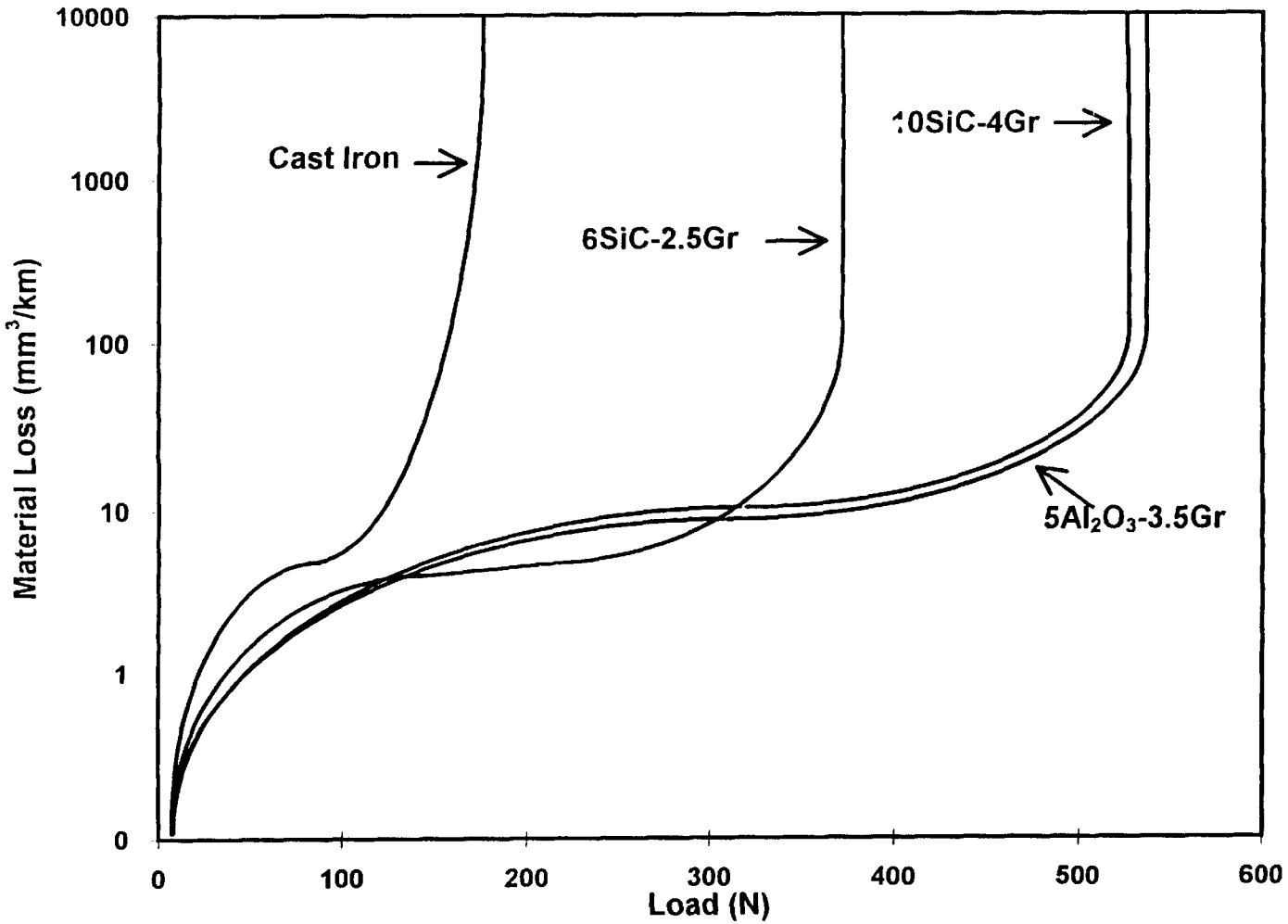
FIG. 2 compares wear test results of an aluminum-base alloy containing 5 volume percent alumina and 3.5 volume percent graphite to cast iron and silicon carbide-graphite hybrid composites.

Cutting the cast material into 10×10×5 mm wear blocks provided test samples for dry sliding wear in accordance with "Standard Practice for Ranking Resistance of Materials to Sliding Wear Using Block-on-Ring Wear Test," G77, Annual Book of ASTM Standards, ASTM, Philadelphia, Pa., 1984 pp. 446–62. Testing these samples against ring material SAE-52100, at 0.5 mn/s sliding speed and 1000 m sliding distance produced the results of FIG. 2. This alumina-graphite composite performed as well as or better than a composite containing higher volume fractions of silicon carbide and graphite. At high loads, the alumina-graphite composite did not appear to generate as much heat by friction as the silicon carbide composite, as witnessed by less discolouration of the wear ring and temperature measurements made in the bulk volume of the block material.

Machinability

The machinability of the composite was determined by side milling tests. A FADAL VMC 6030 CNC milling machine (22hp (16.4 kw), 100 rpm) contained two inserts. These inserts consisted of PVD TiCN-coated carbides containing the following geometry:

Clearance angle: 15°

Wiper clearance angle: 15°

Entering angle: 90°

The total diameter was 1.5 in. (38.1 mm) with an axial depth of cut of 0.25 in. (0.63 cm) or 0.10 in. (0.25 cm). Testing all composites under dry conditions accelerated the wear tests.

Figure 3:
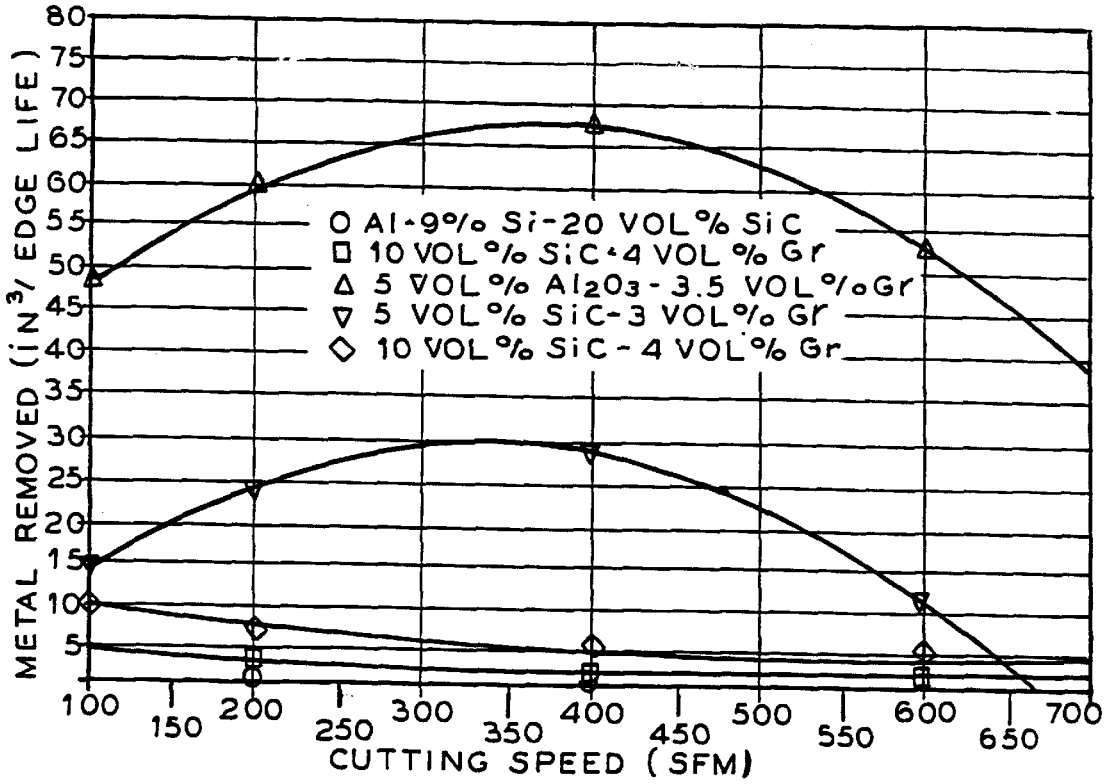
FIG. 3 compares wear test results for an aluminum-base alloy containing 5 volume percent alumina and 3.5 volume percent graphite to silicon carbide/graphite hybrid composites.

FIG. 3 illustrates that the alumina-containing composite has better machineability than 6 vol. % SiC–4 vol. % Gr composites and far superior to 10 vol. % SiC–4 vol. % Gr composites of similar wear resistance. The alumina particles (not having the hardness of silicon carbide particles), machined much better than silicon carbide particles. Furthermore, the alumina alloy machines at faster speeds that in turn allow faster finishing. In addition, the brittle nickel aluminide compound precipitated throughout the matrix reduces the ductility of the aluminium-base matrix to lower the energy required to shear metal chips. Another advantage of the alumina-containing composite is less sensitivity to tool cutting speed.

An alternative method for producing the alloy consists of melting an aluminum-matrix-alumina-containing composite and mixing the carbon or graphite into this mixture. This provides a low-cost means of introducing alumina and lubricating phase into the melt. Optionally, adding additional aluminum alloy to these mixtures could lower the volume percent alumina in the melt.

Alternatively other additives such as $AlB_2$, AlN, MgO, $Ni_2B$, $Si_3N_4$, TiN, $Y_2O_3$, $ZrB_2$, and $ZrO_2$ may form neutral buoyancy composites with carbon or graphite.

Unfortunately, the most useful ranges of alumina and graphite composites for some applications may not fall completely within the ideal neutral buoyancy ranges. The possible composite ranges for hindered settling of alumina include about the ranges of Table 3 by volume percent.

TABLE 3

| Material | Broad | Intermediate | Narrow |
|---|---|---|---|
| Alumina | 0.4 to 8.8 | 2 to 6 | 3 to 6 |
| Carbon | 1 to 4.4 | 1.5 to 4 | 2 to 3.8 |
| Graphite | 1 to 4.4 | 1.5 to 4 | 2 to 3.8 |
| Nickel Aluminide | 0.5 to 20 | 1 to 15 | 2 to 12 |

The casting process allows molten mixtures having a temperature above the liquidus temperature of matrix alloy to be poured directing into molds. For purposes of this specification, liquidus of the matrix alloy is the temperature where the matrix alloy, other than intermetallics, is essentially one hundred percent liquid. This casting process has the ability to cast composites, containing by volume percent, 0.4 to 40 alumina, 1 to 15 graphite or carbon and 1 to 20 nickel-bearing aluminide.

When casting aluminum-matrix-alumina-graphite composites however, the ratio of volume fraction of alumina to carbon or graphite advantageously ranges between 0.3 and 2.0. Most advantageously, this volume ratio ranges between 0.4 and 1.2. This range effectively hinders the settling of the alumina. To further optimize the distribution of alumina, stirring the melt just before casting facilitates even distribution of the particulate. The hindered settling ideally limits settling for a sufficient period of time to solidify the casting without unacceptable settling. If the molten-metal-alumina-graphite mixture achieves neutral buoyancy, the alumina does not sink and the time available to solidify the casting without segregation greatly increases. These neutral buoyancy mixtures are stable at temperatures above the dissolution temperature of nickel aluminides.

Particles size is important for maximizing the stabilizing effect of carbon or graphite. Ideally alumina and carbon or graphite has about average particle size ranges of Table 4, as measured in micrometers.

TABLE 4

| Material | Broad | Intermediate | Narrow |
|---|---|---|---|
| Alumina | 3 to 250 | 10 to 80 | 10 to 40 |
| Carbon or Graphite | 10 to 250 | 20 to 200 | 30 to 150 |

Since settling velocity is directly proportional to particle diameter, using alumina particles having a smaller particle size than the graphite contributes to stabilizing the molten mixture. For example, using an alumina particle size of less than one half of the graphite size contributes toward stabilizing the mixture. A graphite to alumina particle size ratio of at least 5 to 1 or even 10 to 1 stabilizes molten mixtures containing graphite particle sizes up to and above 100 microns. Most advantageously, the composite contains small alumina particles (<20$\mu$m) in combination with large graphite particles (>50 $\mu$m). Furthermore, large graphite particles are beneficial in preventing aluminum from covering or forming over the graphite—in composites requiring surface level graphite for effective graphite film lubrication.

Similarly, increasing the numerical ratio of alumina particles to graphite particles further stabilizes the melt. Having a ratio of 3 or 5 alumina particles for every graphite particle contributes stability to the mixture. Most advantageously, a ratio of at least 10 alumina particles per graphite particle stabilizes the mixture. Furthermore, a volumetric ratio of alumina to graphite of at least 1.2 optimizes wear resistance without sacrificing castability. Most advantageously, this ratio is at least 1.5 to optimize wear resistance.

Alternatively, the invention may use chopped alumina or chopped graphite fibers. Chopped alumina containing a greater surface area per unit volume than alumina particles is especially effective with graphite for hindering settling. Using chopped fibers may allow a greater proportion of alumina in combination with a particular amount of graphite. Adding chopped alumina or chopped graphite fibers in their nickel-coated forms facilitates introduction of the chopped fibers into the melt.

A particular example of a composite with unexpected wear resistance consists essentially of 2.5 to 4 volume percent graphite, 3 to 8 volume percent alumina and 1 to 12 volume percent nickel aluminide. This combination of additives can produce composites having performance equal to composites having as high as 20 volume percent silicon carbide and no nickel aluminides or graphite.

The alumina-graphite composites have extremely good wear resistance, especially at high loads. Furthermore, alumina-containing composites have improved tool life and cutting speed sensitivity in comparison to silicon carbide containing composites. Mixing this combination of sinking-prone alumina and floating-prone graphite or carbon leads to formation of composites which are castable without significant changes to conventional casting methods. This relatively small quantity of alumina, graphite and nickel alumide provides a commercially castable composite, with excellent machinability and wear resistance that surpasses dry sliding wear resistance achieved with cast iron and silicon carbide hybrid composites.

In accordance with the provisions of the statute, this specification illustrates and describes specific embodiments of the invention. Those skilled in the art will understand that the claims cover changes in the form of the invention and that certain features of the invention may operate advantageously without a corresponding use of the other features.

What is claimed is:

1. A cast neutral buoyancy aluminum base metal matrix composite consisting of, by volume percent, at least about 0.4 to about 8.8% spherical particle alumina, the spherical particle alumina having an average diameter between 10 to about 20 $\mu$m, about 0.5 to about 20% nickel-bearing aluminide dispersoids, at least about 1 to about 4.4% lubricating phase selected from the group consisting of carbon and graphite, the lubricating phase having an average size of about 30 to 150 $\mu$m, 5 to 19 (weight) % silicon, 0.1 to 1 (weight) % magnesium, 0.5–2 (weight) % iron, a volumetric ratio of alumina to lubricating phase between 0.3 to 2.0, and the balance aluminum.

* * * * *